US006030113A

United States Patent [19]

Bergman et al.

[11] Patent Number: 6,030,113

[45] Date of Patent: Feb. 29, 2000

[54] MIXING APPARATUS AND METHOD FOR MIXING BLACK LIQUOR FROM CELLULOSE PRODUCTION WITH ASH FROM FLUE GASES FORMED FROM COMBUSTION OF BLACK LIQUOR

[75] Inventors: Jan Bergman, Orglelvägen; Hans Sjöberg, Valebergsvägen, both of Sweden

[73] Assignee: Kvaerner Pulping AB, Karlstad, Sweden

[21] Appl. No.: 09/113,186

[22] Filed: Jul. 10, 1998

Related U.S. Application Data

[63] Continuation-in-part of application No. PCT/SE97/00016, Jan. 9, 1997.

[30] Foreign Application Priority Data

Jan. 12, 1996 [SE] Sweden ..... 9600100

[51] Int. Cl.[7] ..... B01F 7/22; B01F 7/26

[52] U.S. Cl. ..... 366/264; 366/270; 366/306; 366/307; 366/317; 422/227; 422/228

[58] Field of Search ..... 366/64–66, 96–98, 366/102–104, 262–265, 270, 306, 307, 315, 317; 422/227, 228

[56] References Cited

U.S. PATENT DOCUMENTS

| | | | |
|---|---|---|---|
| 531,718 | 1/1895 | Detwiler et al. | 366/307 |
| 988,167 | 3/1911 | Brannen | 366/307 |
| 1,084,210 | 1/1914 | Howard . | |
| 1,351,352 | 8/1920 | Stevens | 366/306 |
| 1,768,870 | 7/1930 | Valentine | 366/264 |
| 1,768,955 | 7/1930 | Johnson | 366/307 |
| 1,768,956 | 7/1930 | Johnson | 366/264 |
| 1,768,957 | 7/1930 | Johnson | 366/264 |
| 1,976,955 | 10/1934 | MacLean | 366/264 |
| 3,319,937 | 5/1967 | Wilson et al. | 366/307 |
| 3,343,815 | 9/1967 | Kingma | 366/317 |
| 4,483,624 | 11/1984 | Bacon, Jr. et al. | 366/307 |
| 4,728,731 | 3/1988 | Raehse et al. | 366/307 |
| 4,798,131 | 1/1989 | Ohta et al. | 366/307 |
| 4,893,941 | 1/1990 | Wayte | 366/317 |
| 4,934,828 | 6/1990 | Janssen | 366/307 |
| 5,160,041 | 11/1992 | Taniguchi et al. | 366/307 |
| 5,188,808 | 2/1993 | Lilja et al. | 366/307 |

FOREIGN PATENT DOCUMENTS

| | | |
|---|---|---|
| 0 394 007 A2 | 10/1990 | European Pat. Off. . |
| 41 32 154 A1 | 4/1993 | Germany . |
| 2 161 394 | 1/1986 | United Kingdom . |

*Primary Examiner*—Charles E. Cooley
*Attorney, Agent, or Firm*—Jeffrey S. Melcher

[57] ABSTRACT

A mixing apparatus for mixing black liquor from cellulose production with ash from flue gases which is generated on combustion of black liquor. The mixing apparatus contains a cylindrical tank, a stirrer mechanism having a propeller secured on the upper part of a vertical shaft, rotating baffles secured on the lower part of the shaft, and stationary, vertical, radial baffles arranged around, and at a distance from, the rotating baffles. The invention also provides a method for mixing black liquor and ash.

13 Claims, 2 Drawing Sheets

MIXING APPARATUS AND METHOD FOR MIXING BLACK LIQUOR FROM CELLULOSE PRODUCTION WITH ASH FROM FLUE GASES FORMED FROM COMBUSTION OF BLACK LIQUOR

This application is a continuation-in-part of PCT/SE97/00016, filed on Jan. 9, 1997, and claims priority to Swedish Patent Application No. 9600100-3, filed on Jan. 12, 1996, the complete disclosures of which are incorporated herein by reference.

FIELD OF THE INVENTION

The invention relates to an improved mixing apparatus for mixing black liquor from cellulose production with ash from the flue gases. The invention also relates to a method of mixing ash with black liquor.

BACKGROUND OF THE INVENTION

Mixing separated ash from the flue gases with black liquor which is to be combusted in a recovery boiler is a well-known technique that has been practiced over many decades. Various installations for carrying out this kind of mixing have been constructed over the years. Such mixing apparatuses are referred to as mixer tanks and normally consist of a vessel equipped with a stirrer, a liquor inlet, a liquor outlet, ventilation pipes, an ash inlet and, in most cases, a heating device. The stirrers generally used have been slow-moving stirrers with arms that sweep along the periphery of the mixer tank and do not create sufficient turbulence to prevent fairly large particles from settling to the bottom zone. The lowermost arms of the stirrer are therefore designed as scraper tools which operate near the bottom and at that location effect a mechanical working of the sedimented material. The material is broken up into smaller particles which can then gradually be lifted upwards to a higher level in the tank and removed through the outlet.

To ensure that the liquor distribution in the furnace will function in a trouble-free manner, the injected liquor must not contain excessively large particles, since these can clog up the injection nozzles. For this reason, the liquor is usually screened through a fixed screen called a holed plate, which is placed in front of the outlet of the mixer tank.

One example of a mixer tank design is described in U.S. Pat. No. 5,405,502. The mixer tank is built into, or arranged on the outside of, the storage tank for black liquor. The apparatus is based on the abovementioned principle, but since the mixer tank is preferably arranged inside the storage tank for black liquor, the finish-mixed product is allowed to flow into the storage tank through an overflow, without passing through any screen or traveling via any pump.

A problem with the known apparatuses which effect slow stirring is that the mixture of ash and liquor is not as homogeneous as possible, and relatively coarse ash particles are not dissolved. These coarse ash particles can undesirably clog the screen plate and pumps. The ash which is supplied, and which for the most part consists of finely particulate material, has a tendency to lump together. These lumps may cause operating breakdowns. Furthermore, the lumps cannot be dissolved chemically by means of a long dwell time, since the liquor is concentrated and saturated with the same chemicals the ash comprises, namely various sodium salts, such as sodium carbonate and sodium sulphate. The ash may also sinters together in certain parts of the recovery boiler. When sintered coatings of this kind come loose, for example in association with soot-blowing, they fall downwards in the ash system. It is necessary for the large lumps to be broken up mechanically. Therefore, in most cases the lowermost arms of the stirrer have been designed as scraper tools which operate near the bottom and in that location effect a mechanical working of the sedimented material. Working the ash lumps breaks it up into smaller particles which can gradually be lifted upwards to a higher level in the tank and then removed through the holes in the screen plate. This results in undesirable wear and tear on the bottom scraper, which can be made worse if stones and metal scrap accompany the liquor or the ash into the tank.

There has therefore long been a need to be able to produce a mixer tank for black liquor and ash which overcomes the abovementioned problems.

SUMMARY OF THE INVENTION

An objective of the present invention is to provide a mixing tank which avoids the problems associated with scrapers used in conventional mixing tanks.

The above objective is obtained by a mixing apparatus for mixing black liquor formed from cellulose production with ash formed from flue gases generated during combustion of black liquor to form a mixture of ash and black liquor. The mixing apparatus comprises:

- a walled vessel having a side wall and a bottom wall defining an internal volume, the internal volume having an upper zone and a lower zone;
- at least one inlet in the walled vessel for supplying black liquor to the internal volume;
- at least one inlet in the walled vessel for supplying ash to the internal volume;
- at least one outlet for removing a mixture of ash and black liquor from the internal volume;
- a vertical shaft rotatably mounted within the internal volume;
- a motor constructed and arranged to rotate the vertical shaft in relation to the walled vessel;
- at least one propeller constructed and arranged on the vertical shaft in the upper zone such that when the vertical shaft rotates the propeller generates a first circular flow of black liquor in the upper zone in which the black liquor flows downward within an inner portion of the upper zone and flows upward in an outer portion of the upper zone; and
- at least one rotating baffle constructed and arranged on the vertical shaft in the lower zone such that when the vertical shaft is rotated the rotating baffle rotates and thrusts black liquor and solid particles in a direction away from the shaft and towards the walled vessel and generates a second circular flow of black liquor in the lower zone in which the black liquor flows downward at a periphery of the second zone and upwards in an inner portion of the second zone, a bottom of the at least one rotating baffle being spaced from the bottom wall of the walled vessel to avoid friction between the baffle and the walled vessel.

The present invention also provides a method of mixing black liquor formed from cellulose production with ash formed from flue gasses generated during combustion of black liquor. The method comprises:

- supplying black liquor and ash to a mixing vessel containing an internal volume having an upper zone and a lower zone and containing a stirring mechanism;
- generating a first circular flow of the black liquor in the upper zone in which the black liquor flows downward within an inner portion of the upper zone and flows upward in an outer portion of the upper zone;

generating a second circular flow of the black liquor in the lower zone in which the black liquor flows downward at a periphery of the lower zone and upwards in a central portion of the lower zone; and removing a mixture of black liquor and ash from the mixing vessel.

DETAILED DESCRIPTION OF THE INVENTION

Figure 1:
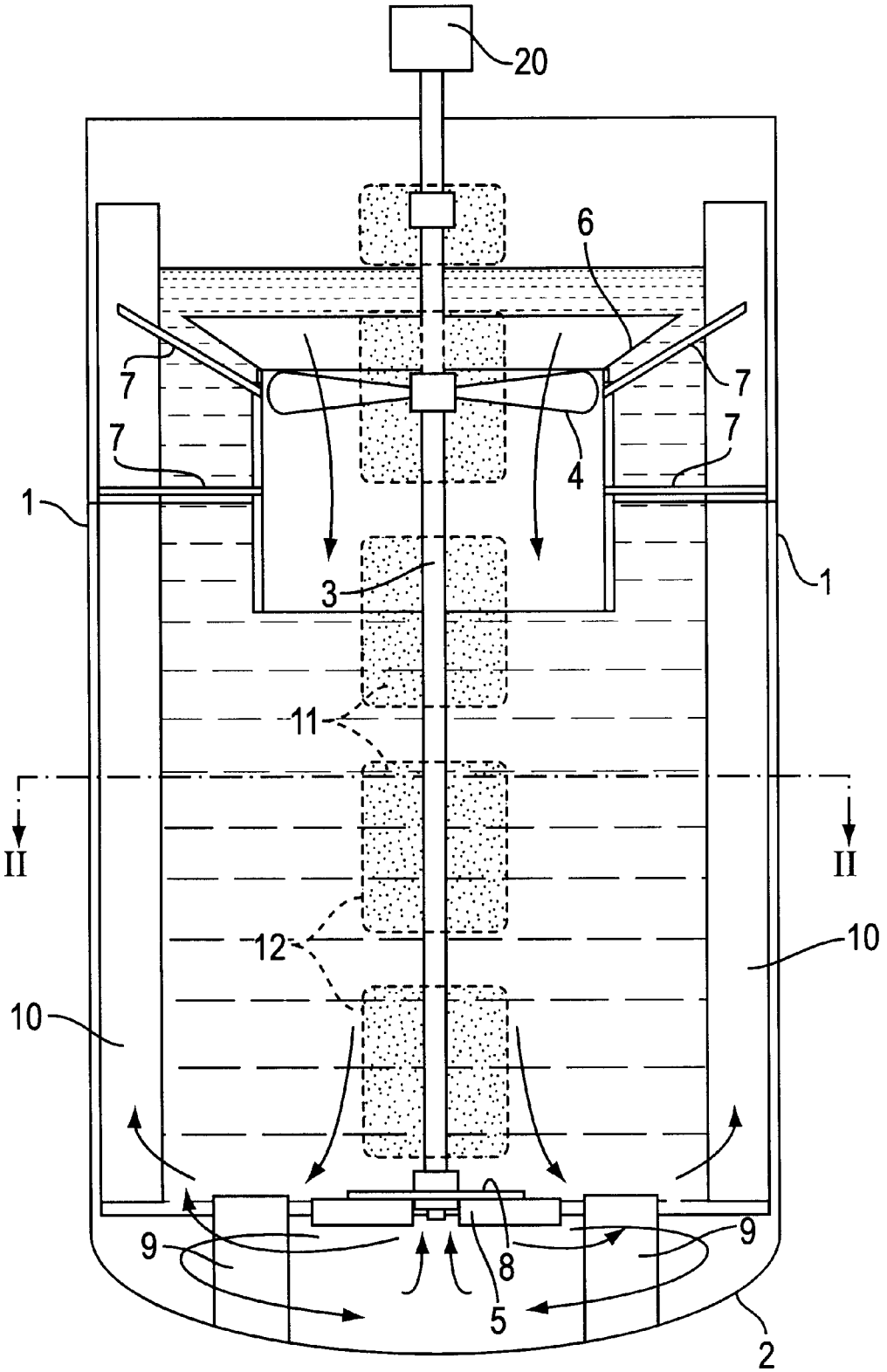
FIG. 1 shows a vertical cross-section through a mixing apparatus according to the present invention.

The invention will now be described in greater detail with reference to the attached figures. FIG. 1 shows a vertical cross-section through a mixing apparatus according to the present invention, comprising a mixer tank, preferably having a cylindrical design of side wall 1, and having a curved bottom wall 2. Arranged inside the mixer tank is a stirrer mechanism comprising a shaft 3 suspended centrally in the tank in an appropriate manner and preferably driven by an electric motor 20. Other types of motors can be used to drive the shaft, such as hydraulic, steam, or combustion engines. At least one propeller 4 is secured on the upper part of the shaft 3, and at least one radial rotating baffle 5 is secured on the lower part of the shaft. Usually, a plurality of rotating baffles 5 are utilized. The propeller 4 is preferably surrounded by a nozzle or draft tube 6 which extends down in the tank. The length of the nozzle can be adjusted to provide desired flow applications for the particular application. Suitable lengths have been found to be about ¼ to about ½ the length of the tank. The present invention is not limited to these lengths. The propeller 4 generates a downward flow of the black liquor in a central portion of the tank. The top of the nozzle 6 should be below the surface of the black liquor or a side opening should be provided in the nozzle 6 above the rotating propeller so that at least a portion of the black liquor flowing upward in the periphery of the mixer tank can flow into the nozzle and be forced back down the central portion of the mixer tank to form a circular flow. The black liquor and the ash can be supplied centrally to the upper part of the mixer tank through generally known devices (not shown). The nozzle 6 is connected to the side wall 1 with the aid of bars 7 or by some other suitable securing device.

The rotating baffles 5 are preferably secured on the lower end of the shaft 3 via a substantially horizontal disc 8. The rotating baffles 5 are constructed and arranged such that black liquor and ash is thrust outward and away from the shaft when the shaft is rotated. In this regard, the rotating baffles 5 should point radially outwards. The rotating baffles 5 can be disc-shaped and vertically attached. The rotating baffles 5 can also have another design, for example curved, paddle-shaped, or can be designed in another way. Nor do the rotating baffles 5 strictly need to be vertically oriented. Preferably, there are a plurality of substantially equally spaced apart rotating baffles 5, more preferably 4 rotating baffles 5 as shown in FIG. 1. There can be a different number of rotating baffles 5, as desired for the particular application.

Preferably, stationary baffles 9 are arranged at a slight radial distance from the outer edges of the rotating baffles 5, such as from about 0.005 meter to about 0.5 meter. These stationary baffles 9 preferably have a vertical orientation and are rectangular in section, with the long sides directed radially. The stationary baffles 9 can be secured on the bottom wall 2, for example by welding.

As black liquor and ash are supplied centrally from the top, the upper propeller 4 generates stirring and creates a downward flow of the liquid mixture in an upper zone of the mixing tank. When the liquid mixture reaches the lower part of the mixer tank, it is deflected towards the periphery, partly with the aid of the disc 8 if present, and travels in an upward direction at the periphery of the mixing tank. Alternatively, if desired a stationary disc (not shown) can be used which is connected to the side wall 1 to redirect the flow of liquid mixture and the baffles are connected to the shaft below the stationary disc (not shown). A portion of the upward flowing liquid can be removed from the mixing tank via the holed plate 11 and another portion of the upward flowing liquid can re-enter the nozzle 6 and be thrust back down the central portion of the mixing tank. In this manner, a circular flow of black liquor and ash is formed in an upper zone of the mixing tank.

Relatively large lumps of ash and other solids will fall down to a level under the disc 8. The shaft 3 rotates quickly, preferably at a speed of about 50 to about 100 rpm, and the ash lumps which come down into the space under the disc 8 are therefore either broken up by the rotating baffles 5 or, if they did not strike the ash lumps, by being broken up against the stationary baffles 9. A lower zone of the mixing tank is defined below the disc 8 or rotating baffles 8. In this lower zone, the rotating baffles 5 create a second circular flow, which flows downwards at the periphery of the tank and flows upward in an inner portion of the tank under the rotating baffles 5, as shown in FIG. 1. Thus, the direction of the second circular flow is opposite to the direction of the circular flow in the upper zone. In the second circular flow, and as a result of the inclination of the curved lower wall 2, relatively large ash lumps are moved towards the center where a vertical flow of liquid directed upwards brings them to the center of the rotating baffles 5, from which the ash lumps are thrust out radially towards the stationary baffles 9. In this manner, the large ash lumps are continuously worked in suspension and broken into small ash particles which can then be carried upwards by the upward flow of black liquor in the upper zone.

Above the disc 8, where the flow of liquid is upwards along the side walls, at least one guide baffle 10 running in the vertical direction can be provided to ensure that this flow is controlled in a suitable manner. Usually, a plurality of guide baffles 10 are utilized. These guide baffles 10, of which there is preferably four, preferably extend all the way up to a point above the surface of the liquid.

A holed plate 11 of a known type can provided for finish-mixed black liquor to flow through. This plate 11 can be slotted down in a vertical space on the outside of the tank and be in contact with the interior of the tank by means of the latter being provided with cutouts 12 in the wall. Running outside the holed plate 11 there can be a vertical channel from which ash/black liquor mixed product is pumped out for combustion in the recovery boiler. Other embodiments of this screening arrangement can also be utilized.

The mixer tank according to the invention generally has a diameter is of about 2 to about 4 meters, a height of about 3 to about 6 meters, with a volume of about 10 to about 30 cubic meters. These tanks are capable of delivering about 25 to about 80 cubic meters of finished mixture per hour, corresponding to about 3 times its internal volume.

Figure 2:
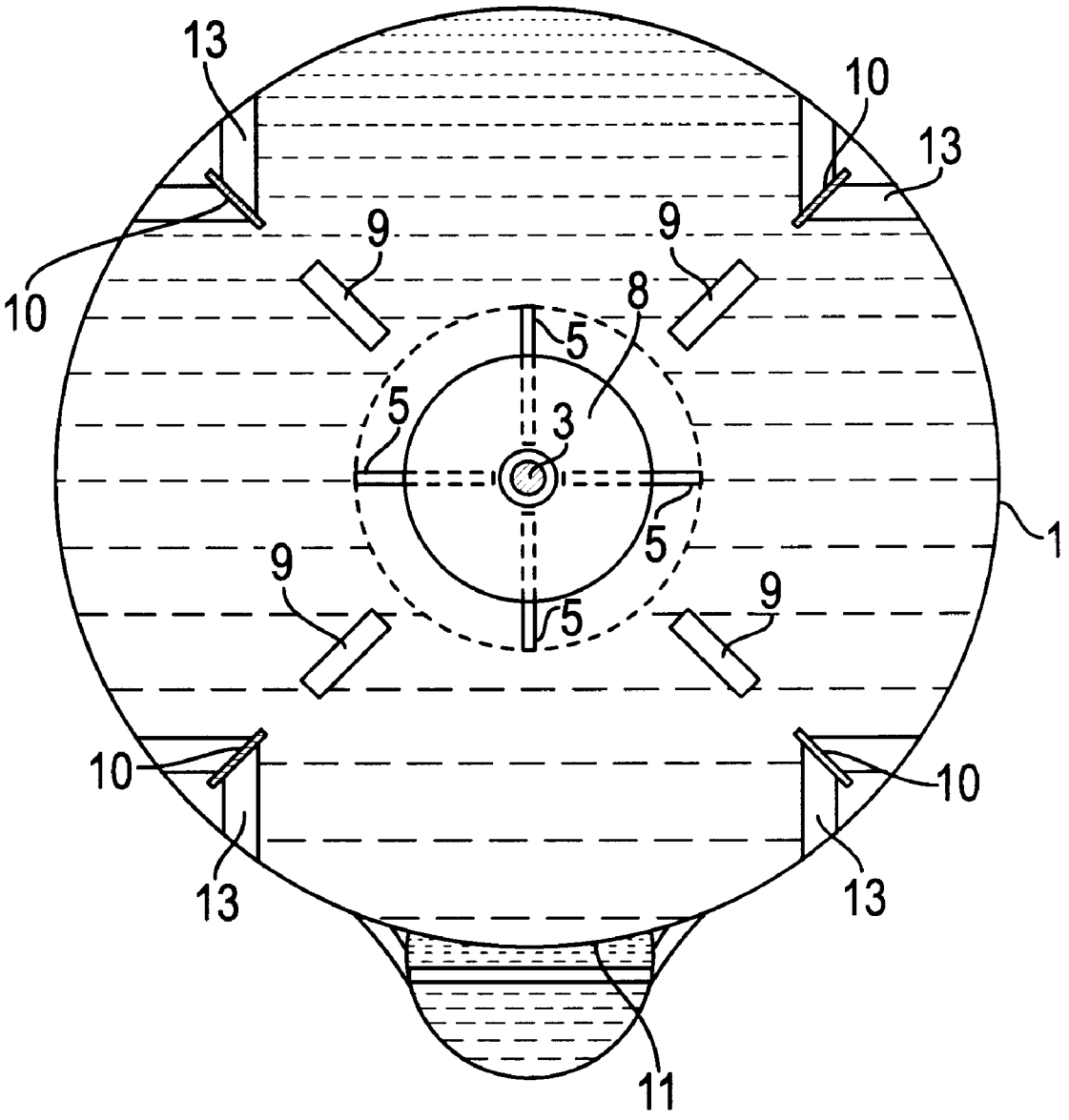
FIG. 2 shows a horizontal cross-section view of the mixing apparatus along the line II—II.

FIG. 2 shows a horizontal cross-section along the line A—A. The reference numbers in FIG. 2 are the same as those in FIG. 1. As can be seen from FIG. 2, the guide baffles 10 near the side wall 1 are preferably suspended on holders 13 which can be of various types. For practical reasons, it is preferred that the guide baffles 10 do not extend completely to the side wall 1.

According to the invention, in the upper zone of the mixing tank a defined upper circular flow is obtained which comprises of a powerful downward central flow of black liquor, in which supplied ash is drawn down in the black liquor, and an upward flow along the outer periphery of the tank and along the outlet screen placed there. In this manner, a portion of the upward flow can be removed from the tank and a portion of the upward flow can be thrust back down the central portion of the tank by the propeller. This upper circular flow provides for good and homogeneous mixing of all finely particulate material, and the risk of lumps of finely particulate dust and liquor forming is minimized. Relatively coarse accompanying lumps of ash are drawn down in the central downward flow, but, when they approach the bottom zone, they are not lifted upward by the upward flow on the outer periphery. Instead the large ash lumps continue into the bottom zone where they are subjected to repeated suspension working by virtue of a lower circular flow comprising a powerful upwardly directed central flow of black liquor and a downwardly directed peripheral flow of black liquor.

Since the particles are worked in suspension, the wear and tear on the components of the lower rotating baffles 5, is not as great as in the case of a bottom scraper which works material lying on the bottom. The size and speed of the rotating baffles 5 can be adapted so that heavier non-ash material, for example metal objects, cannot be lifted up by the vertical flow of liquid generated in the bottom zone and cannot damage the rotating baffles.

The rotating baffles 5 are spaced from the bottom wall 2 to avoid friction between the rotating baffles 5 and the bottom wall 2. The rotating baffles 5 are preferably spaced from the bottom wall 2 an amount which is greater than the size of ash lumps supplied to the mixing tank so that mechanical working of the ash lumps between the bottom wall 2 and the rotating baffles 5 is avoided. Suitable minimum distances between the bottom wall 2 and the rotating baffles 5 for a mixing tank of the size shown in Table 1 are from about 0.02 meter to about 1 meter, preferably from about 0.2 meter to about 0.75 meter, and most preferably about 0.5 meter from the bottom wall 2.

While the invention has been described in detail and with reference to specific embodiments thereof, it will be apparent to those of ordinary skill in the art that various changes and modifications can be made to the claimed invention without departing from the spirit and scope thereof.

We claim:

1. Mixing apparatus for mixing black liquid formed from cellulose production with ash formed from flue gases generated during combustion of black liquor to form a mixture of ash and black liquor, the mixing apparatus comprising:

a walled vessel having a side wall and a bottom wall defining an internal volume;

at least one inlet in said walled vessel for supplying black liquor to said internal volume;

at least one inlet in said walled vessel for supplying ash to said internal volume;

at least one outlet for removing a mixture of ash and black liquor from said internal volume;

a vertical shaft rotatably mounted within said internal volume;

a motor constructed and arranged to rotate said vertical shaft in relation to said walled vessel;

at least one propeller constructed and arranged on an upper portion of said vertical shaft such that when said vertical shaft rotates said propeller generates a first circular flow of black liquor in which said black liquor flows downward within an inner portion of said internal volume and flows upward in an outer portion of said internal volume, said propeller having a diameter less than an inner diameter of said walled vessel;

a draft tube connected to said walled vessel surrounding said propeller for facilitating the flow the black liquor downward in said inner portion of said internal volume;

a disk constructed and arranged on a lower portion of said vertical shaft, wherein during rotation of said vertical shaft said downward flow of black liquor contacts said disc and is directed outward and then upward in said outer portion of said internal volume; and at least one rotating baffle constructed and arranged on a bottom side of said disk such that when said vertical shaft is rotated said at least one rotating baffle rotates and thrusts black liquor and solid particles in a direction away from said shaft and towards said walled vessel and generates a second circular flow of black liquor in which said black liquor flows downward at a periphery of said internal volume and upwards in an inner portion of said internal volume, a bottom of said at least one rotating baffle being spaced from said bottom wall of said walled vessel to avoid friction between said at least one rotating baffle and said walled vessel, and said bottom wall being sloped towards a location under said at least one rotating baffle whereby solid particles flow from an outer periphery of said bottom wall towards said location under said at least one rotating baffle, wherein said at least one rotating baffle comprises a substantially flat paddle.

2. Mixing apparatus for mixing black liquid formed from cellulose production with ash formed from flue gases generated during combustion of black liquor to form a mixture of ash and black liquor, the mixing apparatus comprising:

a walled vessel having a side wall and a bottom wall defining an internal volume;

at least one inlet in said walled vessel for supplying black liquor to said internal volume;

at least one inlet in said walled vessel for supplying ash to said internal volume;

at least one outlet for removing a mixture of ash and black liquor from said internal volume;

a vertical shaft rotatably mounted within said internal volume;

a motor constructed and arranged to rotate said vertical shaft in relation to said walled vessel;

at least one propeller constructed and arranged on an upper portion of said vertical shaft such that when said vertical shaft rotates said propeller generates a first circular flow of black liquor in which said black liquor flows downward within an inner portion of said internal volume and flows upward in an outer portion of said internal volume, said propeller having a diameter less than an inner diameter of said walled vessel;

a draft tube connected to said walled vessel surrounding said propeller for facilitating the flow the black liquor downward in said inner portion of said internal volume;

a disk constructed and arranged on a lower portion of said vertical shaft, wherein during rotation of said vertical shaft said downward flow of black liquor contacts said disc and is directed outward and then upward in said outer portion of said internal volume;

at least one rotating baffle constructed and arranged on a bottom side of said disk such that when said vertical shaft is rotated said at least one rotating baffle rotates and thrusts black liquor and solid particles in a direction away from said shaft and towards said walled vessel and generates a second circular flow of black liquor in which said black liquor flows downward at a periphery of said internal volume and upwards in an inner portion of said internal volume, a bottom of said at least one rotating baffle being spaced from said bottom wall of said walled vessel to avoid friction between said at least one rotating baffle and said walled vessel, and said bottom wall being sloped towards a location under said at least one rotating baffle whereby solid particles flow from an outer periphery of said bottom wall towards said location under said at least one rotating baffle; and at least one stationary vertical guide baffle constructed and arranged along said side wall for guiding said upward flow of black liquor.

3. Mixing apparatus for mixing black liquid formed from cellulose production with ash formed from flue gases generated during combustion of black liquor to form a mixture of ash and black liquor, the mixing apparatus comprising:

a walled vessel having a side wall and a bottom wall defining an internal volume;

at least one inlet in said walled vessel for supplying black liquor to said internal volume;

at least one inlet in said walled vessel for supplying ash to said internal volume;

at least one outlet for removing a mixture of ash and black liquor from said internal volume;

a vertical shaft rotatably mounted within said internal volume;

a motor constructed and arranged to rotate said vertical shaft in relation to said walled vessel;

at least one propeller constructed and arranged on an upper portion of said vertical shaft such that when said vertical shaft rotates said propeller generates a first circular flow of black liquor in which said black liquor flows downward within an inner portion of said internal volume and flows upward in an outer portion of said internal volume, said propeller having a diameter less than an inner diameter of said walled vessel;

a draft tube connected to said walled vessel surrounding said propeller for facilitating the flow the black liquor downward in said inner portion of said internal volume;

a disk constructed and arranged on a lower portion of said vertical shaft, wherein during rotation of said vertical shaft said downward flow of black liquor contacts said disc and is directed outward and then upward in said outer portion of said internal volume; and at least one rotating baffle constructed and arranged on a bottom side of said disk such that when said vertical shaft is rotated said at least one rotating baffle rotates and thrusts black liquor and solid particles in a direction away from said shaft and towards said walled vessel and generates a second circular flow of black liquor in which said black liquor flows downward at a periphery of said internal volume and upwards in an inner portion of said internal volume, a bottom of said at least one rotating baffle being spaced from said bottom wall of said walled vessel to avoid friction between said at least one rotating baffle and said walled vessel, and said bottom wall being sloped towards a location under said at least one rotating baffle whereby solid particles flow from an outer periphery of said bottom wall towards said location under said at least one rotating baffle, wherein said outlet for said product comprises a vertical holed plate along said side wall.

4. Mixing apparatus for mixing black liquid formed from cellulose production with ash formed from flue gases generated during combustion of black liquor to form a mixture of ash and black liquor, the mixing apparatus comprising:

a walled vessel having a side wall and a bottom wall defining an internal volume;

at least one inlet in said walled vessel for supplying black liquor to said internal volume;

at least one inlet in said walled vessel for supplying ash to said internal volume;

at least one outlet for removing a mixture of ash and black liquor from said internal volume;

a vertical shaft rotatably mounted within said internal volume;

a motor constructed and arranged to rotate said vertical shaft in relation to said walled vessel;

at least one propeller constructed and arranged on an upper portion of said vertical shaft such that when said vertical shaft rotates said propeller generates a first circular flow of black liquor in which said black liquor flows downward within an inner portion of said internal volume and flows upward in an outer portion of said internal volume, said propeller having a diameter less than an inner diameter of said walled vessel;

a draft tube connected to said walled vessel surrounding said propeller for facilitating the flow the black liquor downward in said inner portion of said internal volume;

a disk constructed and arranged on a lower portion of said vertical shaft, wherein during rotation of said vertical shaft said downward flow of black liquor contacts said disc and is directed outward and then upward in said outer portion of said internal volume; and at least one rotating baffle constructed and arranged on a bottom side of said disk such that when said vertical shaft is rotated said at least one rotating baffle rotates and thrusts black liquor and solid particles in a direction away from said shaft and towards said walled vessel and generates a second circular flow of black liquor in which said black liquor flows downward at a periphery of said internal volume and upwards in an inner portion of said internal volume, a bottom of said at least one rotating baffle being spaced from said bottom wall of said walled vessel to avoid friction between said at least one rotating baffle and said walled vessel, and said bottom wall being sloped towards a location under said at least one rotating baffle whereby solid particles flow from an outer periphery of said bottom wall towards said location under said at least one rotating baffle.

5. Mixing apparatus according to claim 4, wherein said propeller is surrounded by a nozzle to facilitate the downward flow of black liquor in said inner portion of said internal volume, and a top of said nozzle being below the surface of the black liquor or a side opening provided in said nozzle so that a portion of said black liquor flowing upward in said outer portion of said internal volume can flow into said nozzle.

6. Mixing apparatus according to claim 4, wherein said mixing apparatus comprises four rotating baffles.

7. Mixing apparatus according to claim 4, further comprising at least one stationary baffle mounted to said bottom wall outside of a maximum radius defined by turning said at least one rotating baffle.

8. Mixing apparatus according to claim 7, wherein said at least one stationary baffle projects upward to at least said bottom of said at least one rotating baffle, wherein said solid particles thrust outward by said at least one rotating baffle contact said stationary baffle and are broken into smaller particles.

9. Mixing apparatus according to claim 8, wherein said at least one stationary baffle comprises four stationary baffles substantially equally spaced around said maximum radius of said rotating baffle.

10. Mixing apparatus according to claim 4, wherein a distance between said stationary baffle and said rotating baffle is about 0.005 meter to about 0.5 meter.

11. Mixing apparatus according to claim 4, wherein said at least one rotating baffle comprises four rotating baffles mounted on said bottom side of said disc which are substantially equally spaced apart.

12. Mixing apparatus according to claim 4, wherein a minimum distance between said bottom wall and said at least one rotating baffle is about 0.02 meter to about 1 meter.

13. Mixing apparatus according to claim 4, wherein a minimum distance between said bottom wall and said at least one rotating baffle is about 0.2 meter to about 0.75 meter.

* * * * *